US006384306B1

(12) United States Patent
Hsieh

(10) Patent No.: US 6,384,306 B1
(45) Date of Patent: May 7, 2002

(54) WIND INSTRUMENT

(76) Inventor: Wu-Hong Hsieh, No. 162, Chung Shan 2nd Rd., Lu Chou City, Taipei Hsien (TW)

( * ) Notice: Subject to any disclaimer, the term of this patent is extended or adjusted under 35 U.S.C. 154(b) by 0 days.

(21) Appl. No.: 09/843,868

(22) Filed: Apr. 30, 2001

(51) Int. Cl.[7] ..... G10D 7/00
(52) U.S. Cl. ..... 84/380 R; 84/390
(58) Field of Search ..... 84/380 R, 390, 84/391, 392, 395, 387 A, 381, 382, 383 R, 383 A, 384, 385 R

(56) References Cited

U.S. PATENT DOCUMENTS 3,848,503 A * 11/1974 Paladino ..... 84/380
3,863,540 A * 2/1975 Carree ..... 84/385
5,949,007 A * 9/1999 Runmore ..... 84/380 R

* cited by examiner

*Primary Examiner*—Robert E. Nappi
*Assistant Examiner*—Kim Lockett
(74) *Attorney, Agent, or Firm*—Fei-Fei Chao; Venable, Baetjer, Howard & Civiletti, LLP

(57) ABSTRACT

A wind instrument having a relative pure tone is disclosed. The wind instrument includes a tubular body, a secondary treble key, and a control shaft adapted to be rotated by the secondary treble key. The control shaft is pivotally connected to the tubular body and is securely formed with two spaced transverse pieces having respective apertures defined in alignment. A bar has a pair of opposed, egg-shaped ends, and each of the egg-shaped ends defines a threaded hole therein and a plurality of splits around the threaded hole. A pair of adjusting screws is threadedly engaged with the threaded holes respectively. Therefore, the egg-shaped ends of the bar can be fitted in the apertures of the transverse pieces with no clearance therebetween by adjusting the adjusting screws in the threaded holes carefully.

3 Claims, 6 Drawing Sheets

WIND INSTRUMENT

BACKGROUND OF THE INVENTION

1. Field of the Invention

The present invention relates to a wind instrument and, more particularly, to a wind instrument with a relative pure tone.

2. Description of Related Art

The saxophone is one of the typical wind instruments popular among musicians. As shown in FIG. 5, the saxophone of a conventional type has a secondary treble key (60) which, when being pressed downward, enables the musical instrument to play notes in a high range by way of rotating or rocking a control shaft (80).

In detail, the secondary key (60) includes an off-set rod (61) having an integral crank (62) with a pin (63) attached to the crank (62) at its free end. The control shaft (80) is securely formed with two spaced transverse pieces (64), each defining an aperture (65) for receiving corresponding one of two egg-shaped ends (71*a*) of a bar (70*a*).

The bar (70*a*) is further formed with a transverse aperture (73) defined between its ends (71*a*), for the purpose of receiving a distal, egg-shaped end (71*b*) of a branch (70*b*) extending from the control shaft (80).

Because the lower one of the transverse pieces (64) defines a slot (not numbered) along which the pin (63) of the crank (62) is movable, the whole assembly of the control shaft (80), the transverse pieces (64), the bar (70*a*) and the branch (70*b*) will be rotated or rocked by the pin (63) when the key (60) is being pressed downward. However, a problem arises that the saxophone will have a less favorable tone, since the bar (70*a*) may rattle as the saxophone is being played and even creak as the secondary key (60) is being pressed, due to the fact that the bar (70*a*) is engaged with the transverse pieces (64) and the branch (70*b*) with respective clearances (72), as illustrated in FIG. 6.

Therefore, it is an objective of the invention to provide a wind instrument to mitigate and/or obviate the aforementioned problems.

SUMMARY OF THE INVENTION

The object of the present invention is to provide a wind instrument with a relative pure tone.

Other objects, advantages and novel features of the invention will become more apparent from the following detailed description when taken in conjunction with the accompanying drawings.

DETAILED DESCRIPTION OF THE PREFERRED EMBODIMENT

Figure 1:
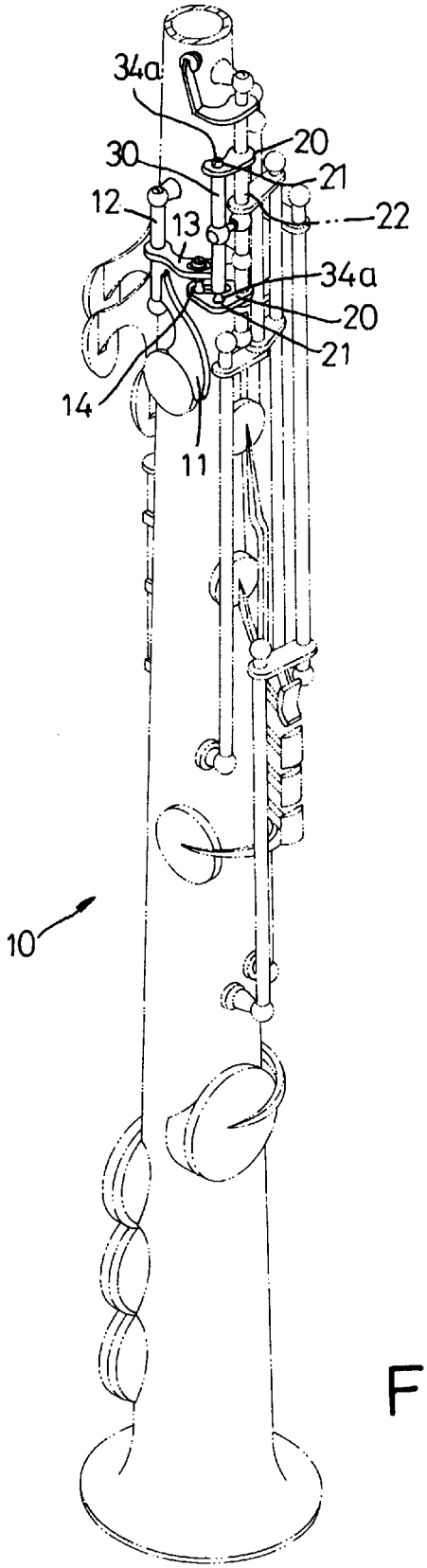
FIG. 1 is an exploded perspective view of a preferred embodiment of a wind instrument, embodied as a saxophone, in accordance with the present invention.

Referring to FIG. 1, a wind instrument constructed in accordance with the present invention includes a tubular body (10) formed with a secondary treble key (11), which enables the body (10) to play notes in a high range by way of rotating a control shaft (22).

As in a conventional saxophone, the secondary key (11) has an off-set rod (12) that is pivotally connected to the tubular body (10) about a first longitudinal axis preferably coaxial with the rod (12) itself.

Figure 2:
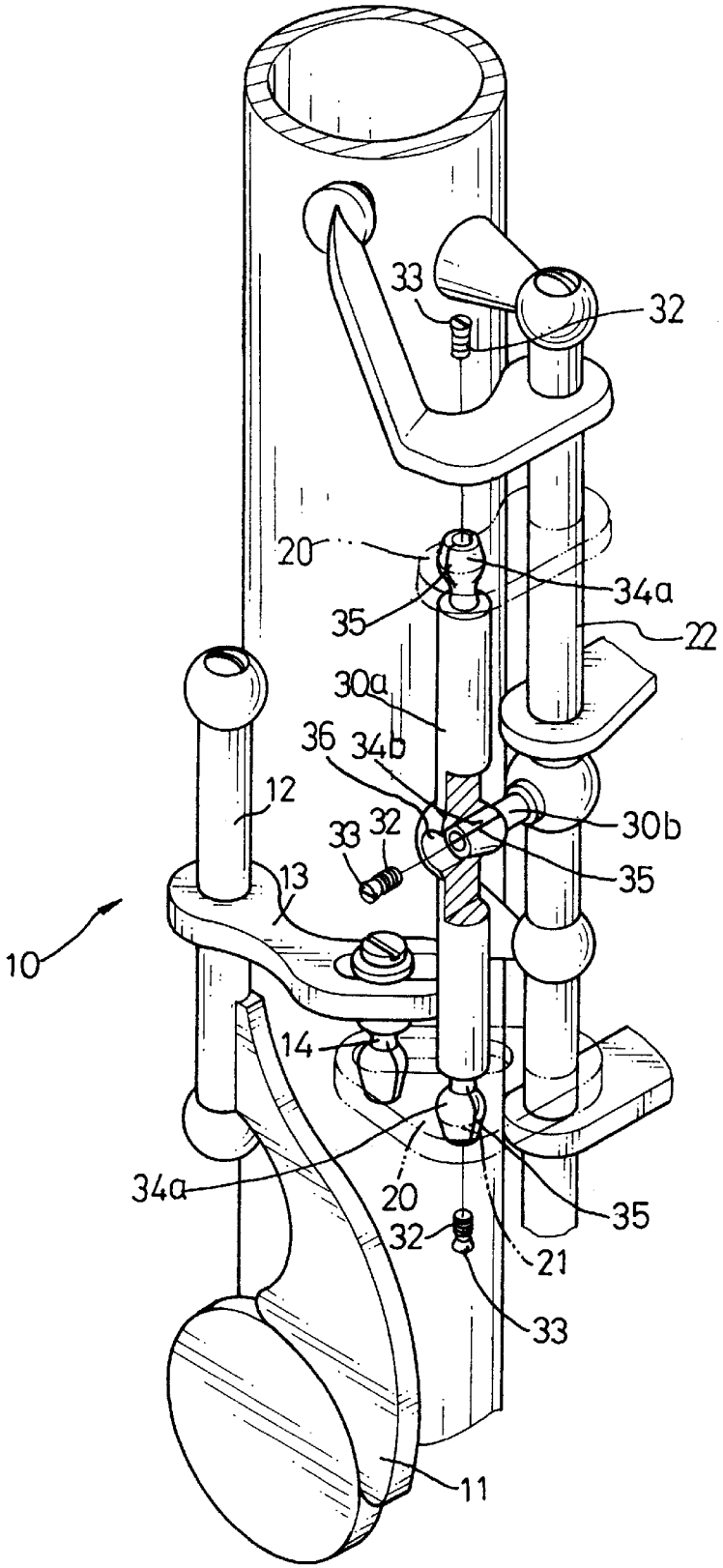
FIG. 2 is a fragmentary, enlarged, perspective view of the wind instrument shown in FIG. 1.

Referring to FIG. 2, the rod (12) has an integral crank (13) with a pin (14) threadedly attached to a free end of the crank (13), and so both the crank (13) and the pin (14) will be turned about the first axis, relative to the body (10), synchronously when the key (11) is pressed.

The control shaft (22) is pivotally connected to the body (10) about a second longitudinal axis, substantially parallel to the first axis and preferably coaxial with the shaft (22) itself. The shaft (22) is securely formed with two spaced transverse pieces (20), each having an aperture (21) defined therein. Additionally, one of the transverse pieces (20) defines a slot (not numbered) along which the pin (14) of the crank (13) is movable.

The transverse pieces (20) are interconnected by a bar (30*a*) that has a pair of opposed, egg-shaped ends (34*a*) received in the apertures (21). Preferably, the bar (30*a*) has a transverse aperture (36) defined between its ends (34*a*), and the control shaft (22) additionally has a branch (30*b*) formed with a distal, egg-shaped end (34*b*) received in the transverse aperture (36) of the bar (30*a*).

Figure 3:
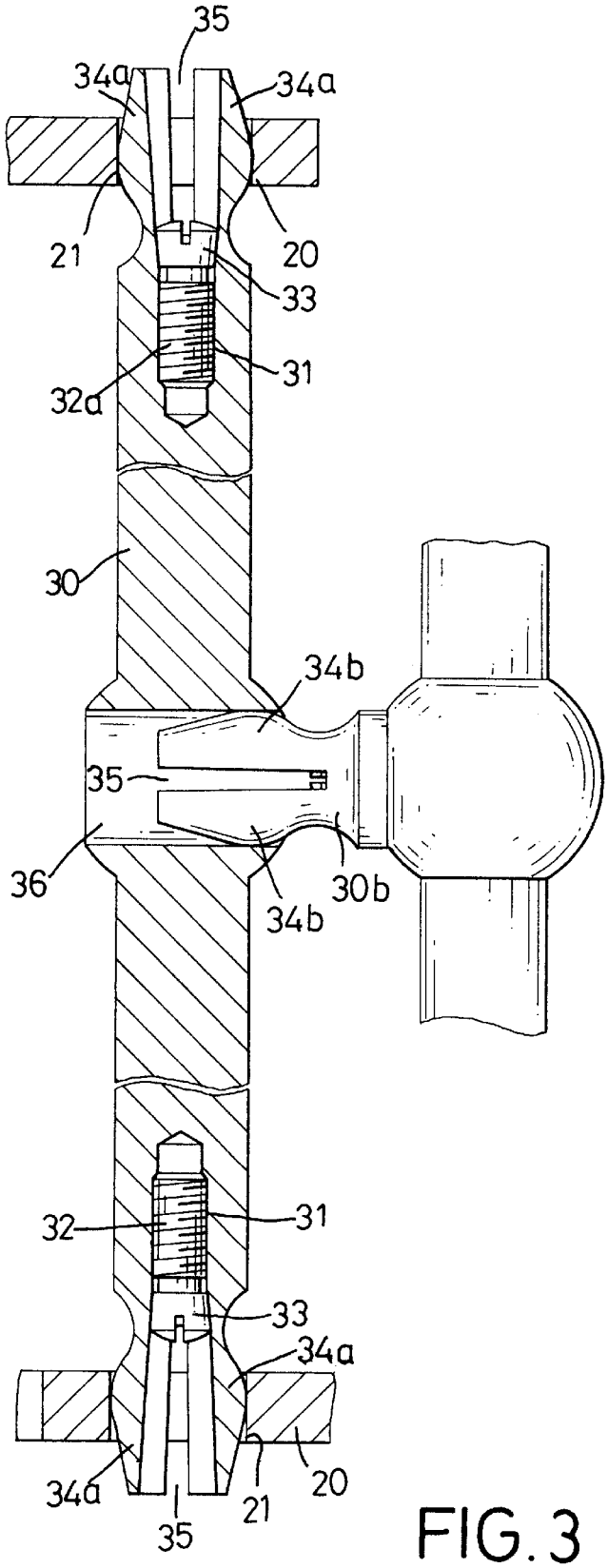
FIG. 3 is a fragmentary, enlarged, cross-sectional view showing a bar included in the wind instrument of FIG. 1.
Figure 4:
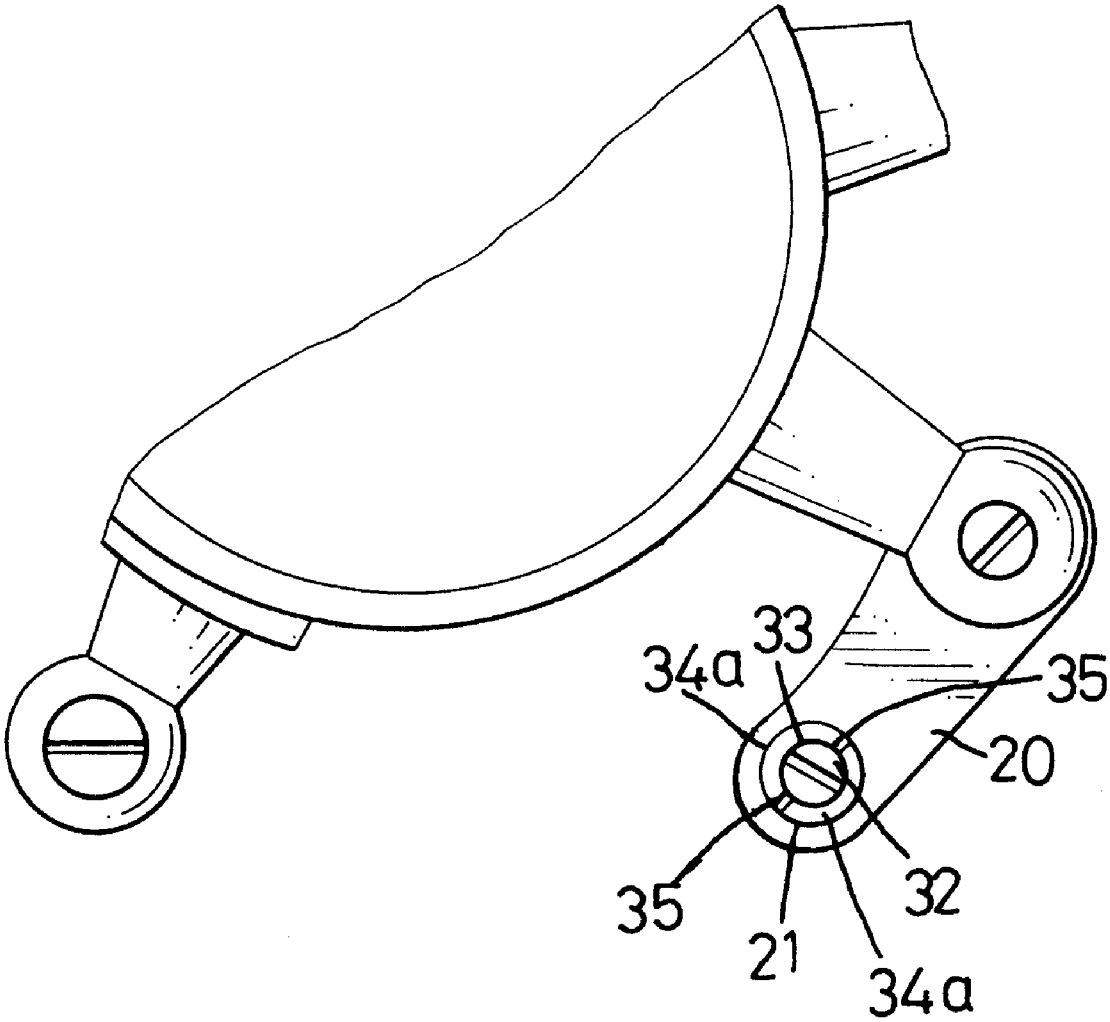
FIG. 4 is a fragmentary top view of the wind instrument shown in FIG. 1.
Figure 5:
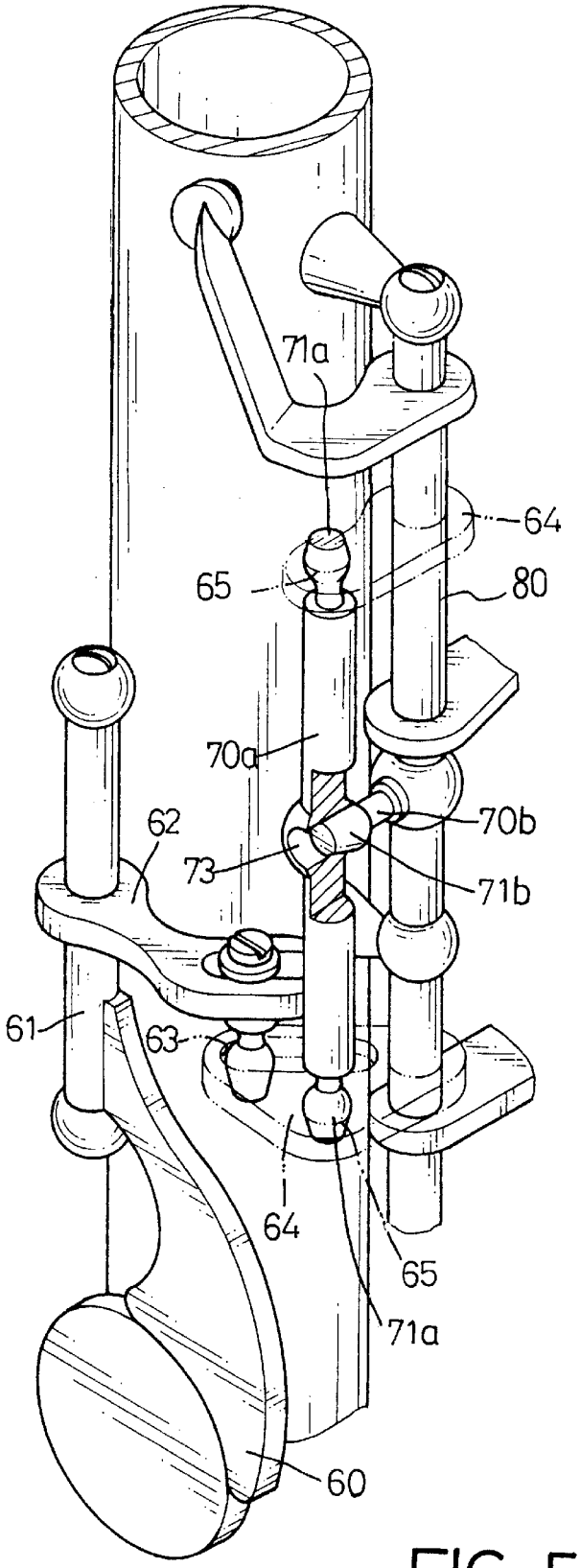
FIG. 5 is a fragmentary perspective view of a conventional saxophone.
Figure 6:
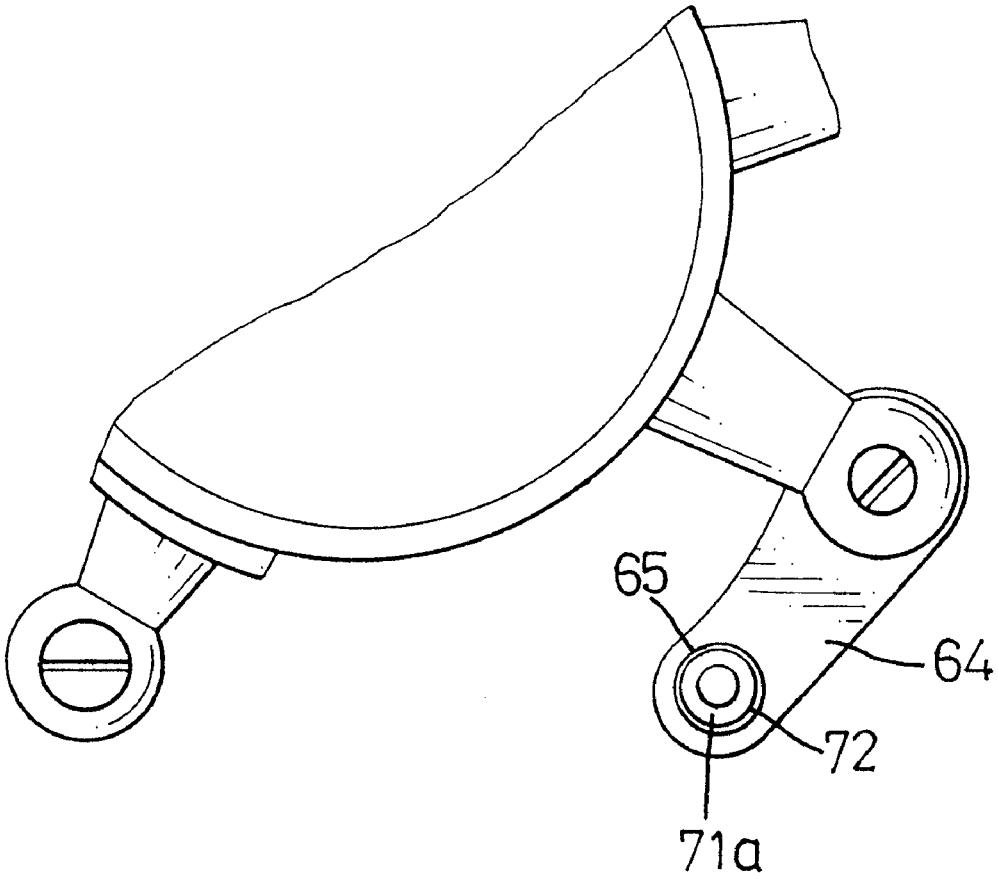
FIG. 6 is a fragmentary top view of the conventional saxophone shown in FIG. 5.

Referring to FIG. 3, each of the egg-shaped ends (34*a*) of the bar (30*a*) has a threaded hole (31), with a plurality of splits (35) defined therearound and an adjusting screw (32) threadedly engaged therewith. The screws (32) have flared heads (33) that are adapted to spread the egg-shaped ends (34*a*) as a result of the deformability of the ends (34*a*) facilitated significantly by the splits (35). Consequently, the spread egg-shaped ends (34*a*) of the bar (30*a*) can be fitted in the apertures (21) of the transverse pieces (20) with no clearance, as shown in FIG. 4, by virtue of adjusting the adjusting screws (32) in the threaded holes (31) carefully. Likewise, the distal, egg-shaped end (34*b*) of the branch (30*b*) is made in the same configuration as that of the egg-shaped ends (34*a*) of the bar (30*a*), and is provided with an additional adjusting screw (32), as shown in FIG. 2, that spreads it within the transverse aperture (36) in the same manner as the above-mentioned screws (32).

Referring back to FIGS. 1 and 2, the relatively rigid assembly of the control shaft (22), the transverse pieces (20), the bar (30*a*) and the branch (30*b*) now serves as a guide bar which can be rotated or rocked about the second longitudinal axis noiselessly by the pin (14) of the crank (13). The bar (30*a*) will neither rattle as the wind instrument is being played nor creak as the secondary key (11) is being pressed, due to its proper connection with the transverse pieces (20) and the branch (30*b*).

From the above description, it is noted that the invention has the following advantages:

1. no rattle of the bar (30*a*):

Because of the proper connection between the bar (30*a*) and the transverse pieces (20) and the branch (30*b*), the bar (30*a*) will not rattle as the wind instrument is being played.

2. no creak of the bar (30*a*):

Because of the proper connection between the bar (30*a*) and the transverse pieces (20) and the branch (30*b*), the bar (30*a*) will not creak as the secondary key (11) is being pressed.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the fill extent indicated by the broad general meaning of the terms in which the appended claims are expressed.

What is claimed is:

1. In a wind instrument of having a tubular body (10), a secondary treble key (11), and a control shaft (22) adapted to be rotated by said secondary treble key (11) in a manner of enabling said tubular body (10) to play notes in a high range, said control shaft (22) being pivotally connected to said tubular body (10) and being securely formed with two spaced transverse pieces (20) having respective apertures (21) defined in alignment, the improvement comprising:

a bar (30*a*) having a pair of opposed, egg-shaped ends (34*a*) received in said apertures (21) of said transverse pieces (20), each of said egg-shaped ends (34*a*) of said bar (30*a*) defining a threaded hole (31) therein and a plurality of splits (35) defined around said threaded hole (31);

a pair of adjusting screws (32) threadedly engaged with said threaded holes (31) of said egg-shaped ends (34*a*) of said bar (30*a*), said adjusting screws (32) each having a flared head (33) adapted to spread a corresponding one of said egg-shaped ends (34*a*) of said bars (30*a*) as a result of deformability of said egg-shaped ends (34*a*) facilitated significantly by said splits (35); and whereby said egg-shaped ends (34*a*) of said bar (30*a*) are selectively received in said apertures (21) of said transverse pieces (20) with no clearance therebetween by adjusting said adjusting screws (32) in said threaded holes (31).

2. The wind instrument as claimed in claim 1, wherein said bar (30*a*) has a transverse aperture (36) defined therein, and wherein said control shaft (22) is formed with a branch (30*b*) having a distal, egg-shaped end (34*b*) received in said transverse aperture (36) of said bar (30*a*).

3. The wind instrument as claimed in claim 2, wherein said distal, egg-shaped end (34*b*) of said branch (30*b*) is made in the same configuration as that of said egg-shaped ends (34*a*) of said bar (30*a*), and wherein an additional adjusting screw (32) is provided for spreading said distal, egg-shaped end (34*b*) in such a way that said distal egg-shaped end (34*b*) is selectively received in said transverse aperture (36) of said bar (30*a*) with no clearance therebetween.

* * * * *